US011912392B2

(12) United States Patent
Sanders

(10) Patent No.: US 11,912,392 B2
(45) Date of Patent: Feb. 27, 2024

(54) FLYWHEEL ACTUATED BACKSTAY TENSIONER

(71) Applicant: Henry Sanders, Hilton Head Island, SC (US)

(72) Inventor: Henry Sanders, Hilton Head Island, SC (US)

( * ) Notice: Subject to any disclaimer, the term of this patent is extended or adjusted under 35 U.S.C. 154(b) by 137 days.

(21) Appl. No.: 17/689,372

(22) Filed: Mar. 8, 2022

(65) Prior Publication Data

US 2023/0286632 A1 Sep. 14, 2023

(51) Int. Cl.
*B63H 9/10* (2006.01)
*B63H 9/08* (2006.01)

(52) U.S. Cl.
CPC ..... *B63H 9/10* (2013.01); *B63H 2009/088* (2013.01)

(58) Field of Classification Search
CPC ... B63H 9/00; B63H 9/08; B63H 9/10; B63H 9/1021; B63H 2009/088; B63H 2009/105
USPC ..... 114/102.1, 102.12, 102.15, 102.16, 114/102.17, 102.18, 102.2, 102.21
See application file for complete search history.

(56) References Cited

U.S. PATENT DOCUMENTS

| | | | | |
|---|---|---|---|---|
| 898,887 | A | 9/1908 | Heyman | |
| 2,162,441 | A | 6/1939 | Mead | |
| 2,538,757 | A | 1/1951 | Bratthauer et al. | |
| 3,610,190 | A * | 10/1971 | Palmer | B63B 15/02 114/91 |
| 3,890,053 | A | 6/1975 | Strecker | |
| 4,006,701 | A * | 2/1977 | Corbellini | B63H 9/067 114/102.24 |
| 4,100,875 | A | 7/1978 | Patterson, III et al. | |
| 4,690,086 | A * | 9/1987 | McKenna | B63B 1/14 114/123 |
| 4,723,499 | A * | 2/1988 | Furgang | B63H 9/1028 114/106 |
| 7,980,780 | B2 | 7/2011 | Hartlemeier | |
| 2004/0069196 | A1 | 4/2004 | Falb | |

* cited by examiner

*Primary Examiner* — Daniel V Venne
(74) *Attorney, Agent, or Firm* — B. Craig Killough

(57) ABSTRACT

A flywheel actuated device for tensioning a backstay cable of a sailboat has a flywheel that is connected to a turnbuckle. The turnbuckle is connected to a cable backstay of a sailboat. Rotation of the flywheel rotates the turnbuckle to increase or relax tension on the cable backstay. The diameter of the flywheel and the weight of the flywheel near an outer circumference of the flywheel allow the flywheel to store rotational energy and cause the flywheel to temporarily freewheel while the sailboat is under sail when a sufficient manual force is applied to the flywheel, which turns the frame of the turnbuckle and provides an initial tension to the cable backstay.

11 Claims, 5 Drawing Sheets

FLYWHEEL ACTUATED BACKSTAY TENSIONER

BACKGROUND OF THE INVENTION

Sailboats have cable stays that hold the mast in a generally vertical position. One of these stays is a backstay cable that connects the upper portion of the mast to the stern of the sailboat.

It is desirable to be able to change the shape of a sail while the vessel is under sail. The shape of the sail is adapted to wind conditions and the heading of the boat relative to the wind. Adjusting the backstay tension will either increase the bend of the mast (backstay tension on) or decrease bend of the mast (backstay eased). Applying or easing tension on the backstay will change the shape of the mast, and therefore, the shape of the mainsail. Typically, backstay tension is eased when sailing downwind, and increased when headed upwind. Adjusting the backstay tension can also alter the shape of the head sail or jib sail, especially for masthead rigged boats.

The backstay on many yachts is only adjustable by a rigger, and is not adjustable while under way. Other vessels have an adjustable backstay device that can be adjusted to suit conditions and point of sail. Examples of adjustable backstay devices are a pulley system, hydraulic backstay actuated devices that are operated by a pump and release valve, and electrically powered backstay adjusters. These devices are either cumbersome to use, or are expensive to purchase and install.

There is a need for an inexpensive and easy to use device to adjust the backstay. Ease of use is particularly important to a helmsman who is sailing without assistance of others. The helmsman may have many functions to perform almost simultaneously depending on wind conditions and heading. It is desirable to have a backstay tensioner that can provide an initial setting of backstay tension with minimal movement and attention by the helmsman.

SUMMARY OF THE INVENTION

A flywheel actuated tensioning device for tensioning a backstay cable of a sailboat has a flywheel that is connected to a turnbuckle. The turnbuckle is connected to a cable backstay of a sailboat. Rotation of the flywheel rotates the turnbuckle to increase or relax tension on the cable backstay.

The diameter of the flywheel and the weight of the flywheel near an outer circumference of the flywheel allow the flywheel to store rotational energy and cause the flywheel to temporarily freewheel while the sailboat is under sail when a sufficient manual force is applied to the flywheel, which turns the frame of the turnbuckle and provides an initial tension to the cable backstay. The helmsman may subsequently fine tune tension on the cable backstay by manual rotation of the flywheel.

BRIEF DRAWING DESCRIPTION

DESCRIPTION OF PREFERRED EMBODIMENTS

Figure 1:
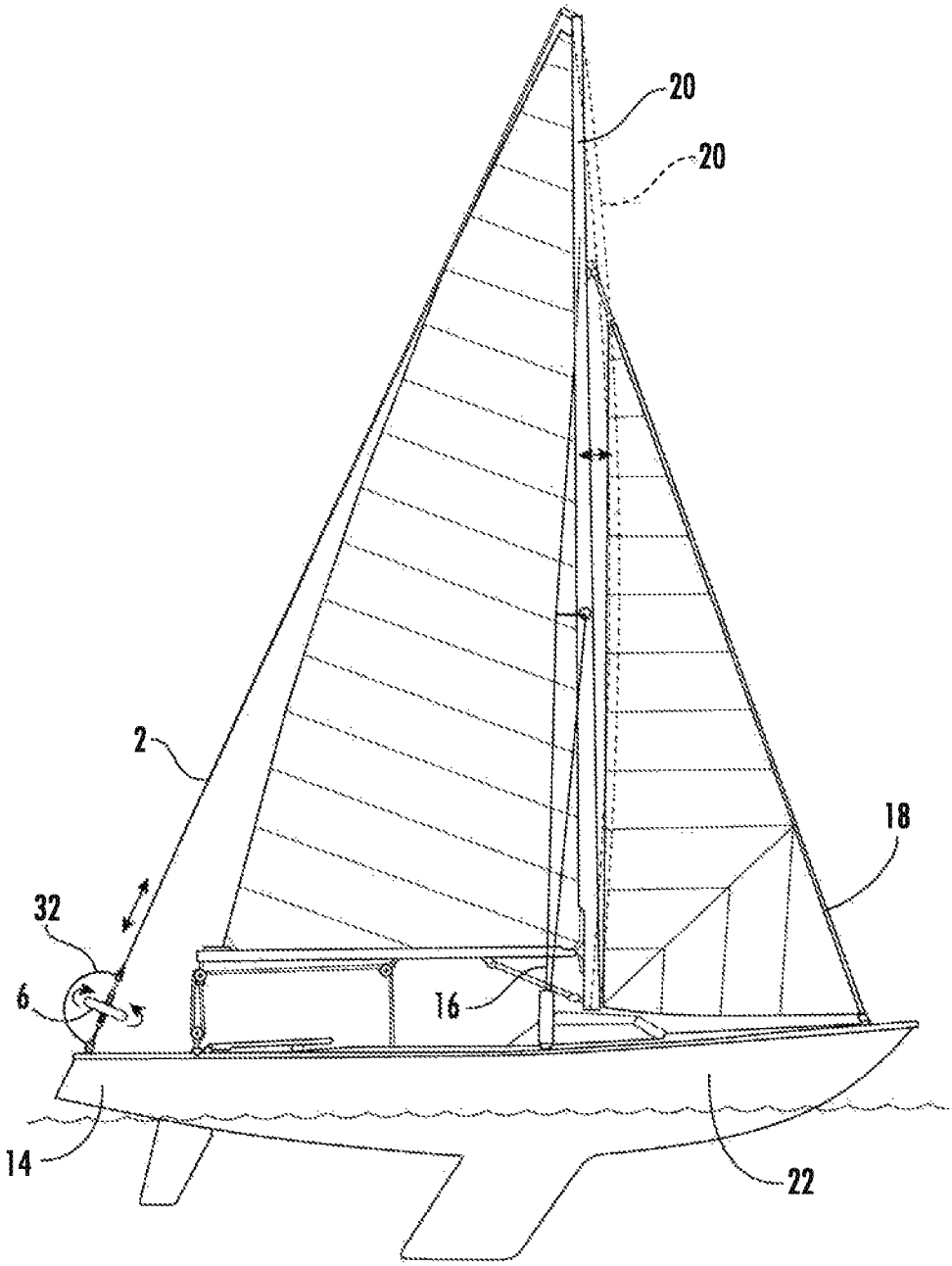
FIG. 1 is an elevation of a sailboat having the flywheel actuated backstay tensioner of the invention.
Figure 2:
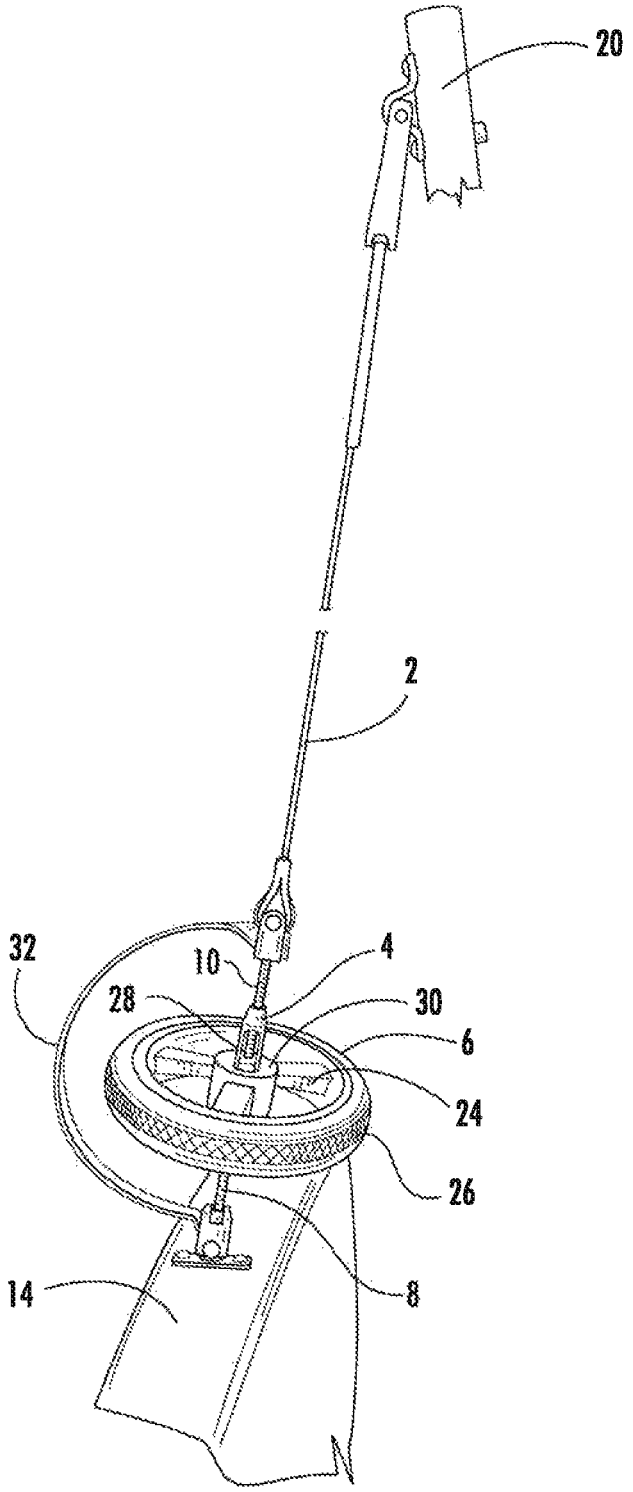
FIG. 2 is an isolation of the flywheel actuated backstay tensioner.
Figure 3:
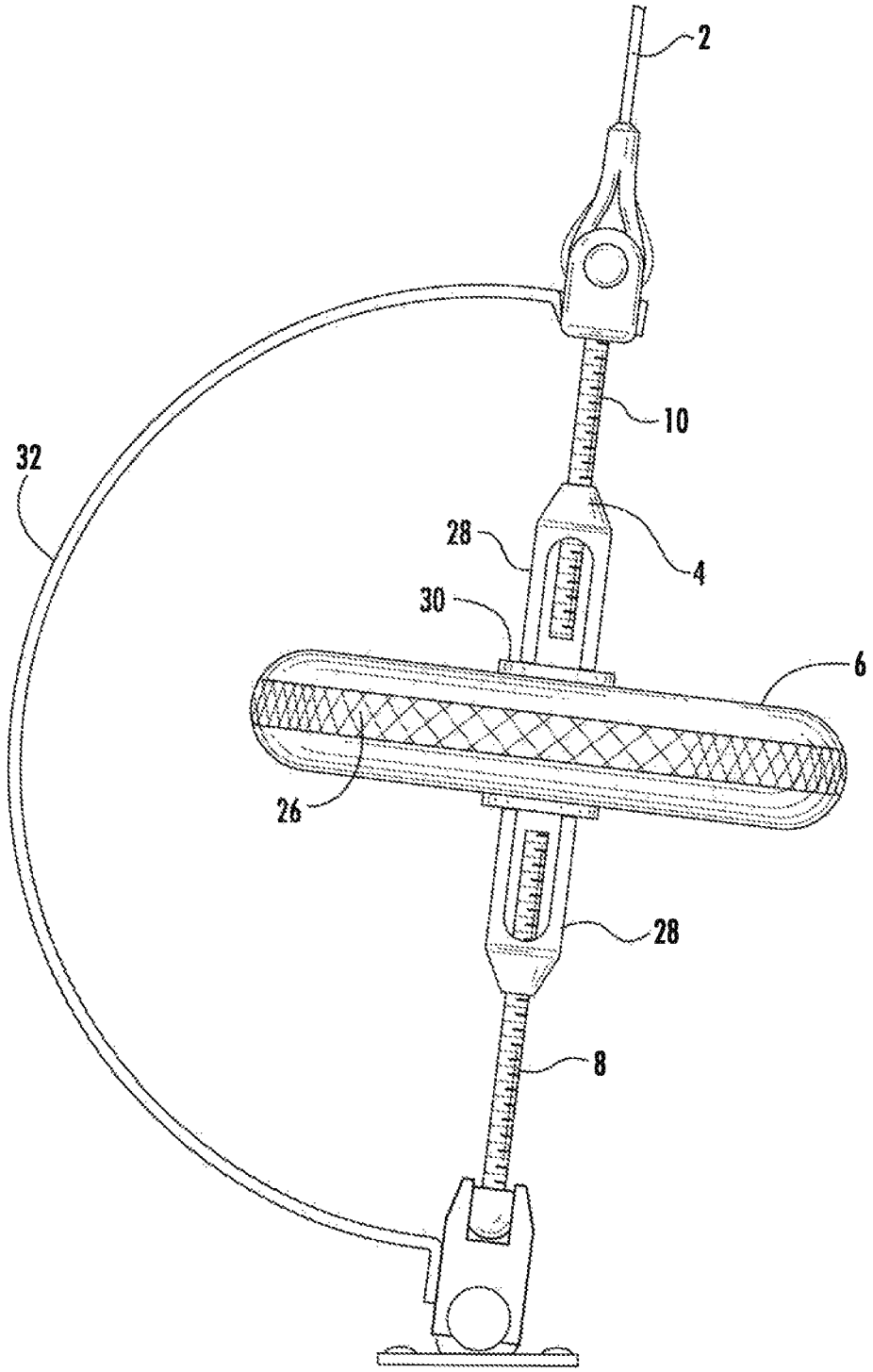
FIG. 3 is an elevation of the flywheel actuated backstay tensioner.
Figure 4:
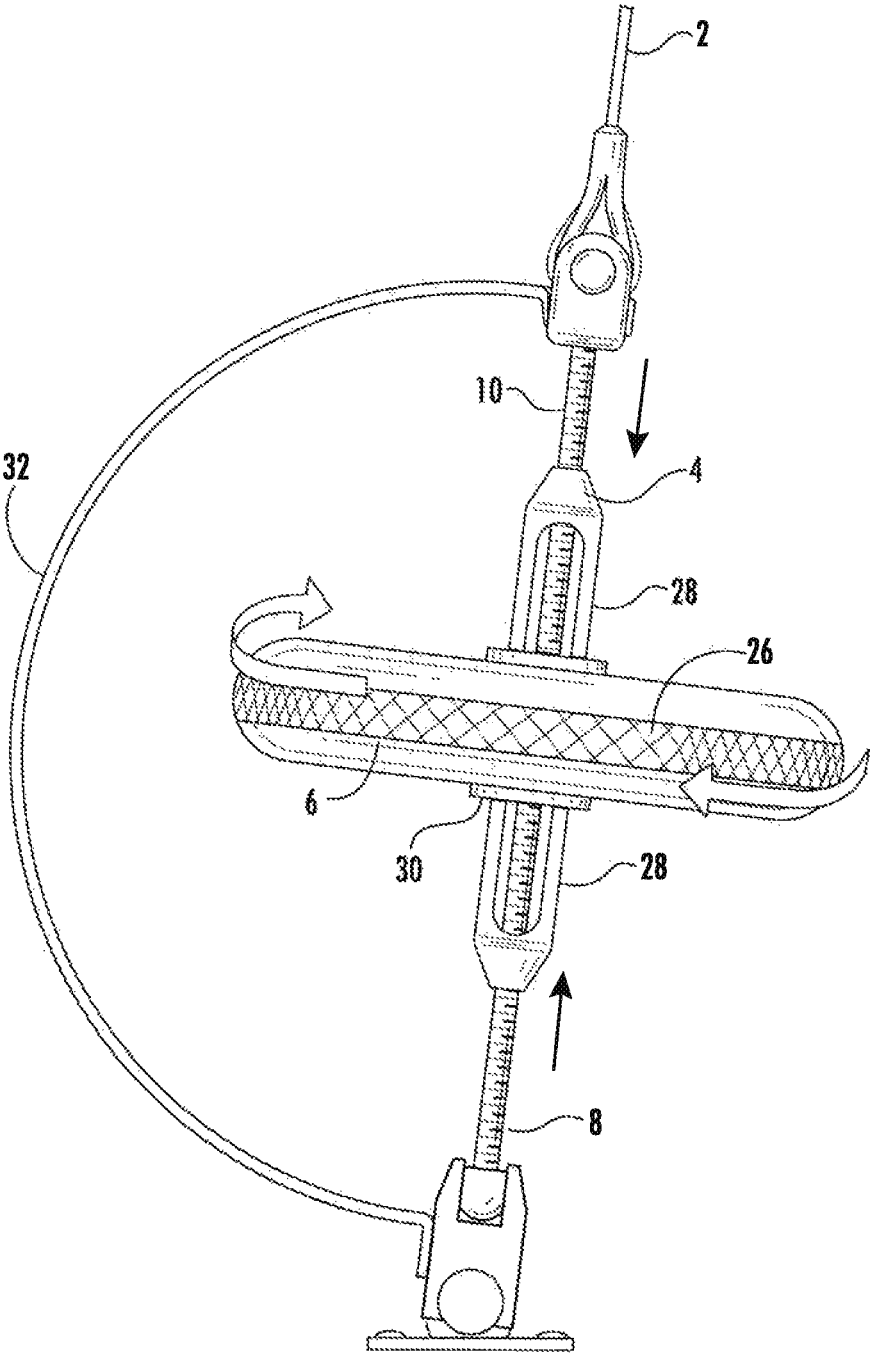
FIG. 4 is an elevation of the flywheel actuated backstay tensioner demonstrating use.
Figure 5:
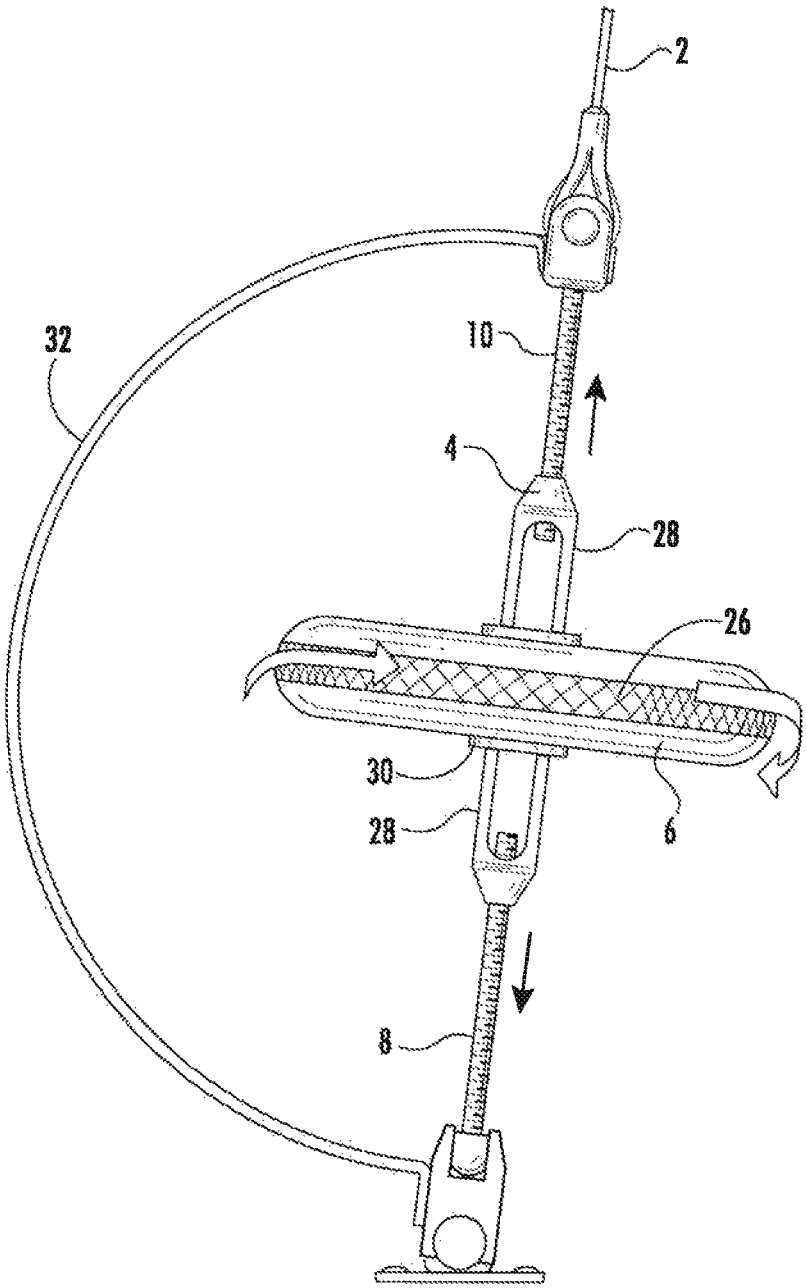
FIG. 5 is another elevation of the flywheel actuated backstay tensioner demonstrating use.

FIG. 1 shows a sailboat 22 under sail. The sailboat has a backstay cable 2 ("backstay") that is connected at one end to the hull 14 of the boat, at or near the stern of the boat. The other end of the backstay is connected to the top of the mast 20. Also shown are shrouds 16 and a forestay 18 that are connected at one end to the hull and are connected to the mast at an opposite end. The forestay, shrouds and backstay hold the mast in a generally vertical position.

The flywheel actuated backstay tensioner is positioned at or near the lower end of the backstay cable 2. The flywheel actuated backstay tensioner is preferably positioned above the attachment point of the backstay to the hull 14, but at a height that is convenient for the helmsman to operate the flywheel actuated backstay tensioner by rotation of the flywheel. One end of the turnbuckle may be attached directly to the hull as shown in the drawing figures. According to another embodiment, the backstay may be formed in two separate pieces so that one end of the first piece is of the backstay is attached to the hull and the other end to the turnbuckle, and with one end of the second piece of the backstay attached to the other side of the turnbuckle and the opposite end of the second piece of the backstay attached to the mast. That is, if the backstay is formed in two pieces, the turnbuckle is positioned between the two parts of the backstay. The lower portion of the backstay must be mounted so that it is relatively static and does not twist or rotate as the flywheel is rotated.

The turnbuckle 4 is rotated by a flywheel 6 that actuates the turnbuckle to apply tension to the backstay 2 or to release tension from the backstay. Added tension on the backstay applies pressure to the top of the mast 20, pulling the mast aft, and changing the shape of the mast and the sail. Reducing tension on the backstay allows the mast to move forward and toward a normal position that is determined by the mast geometry, the shrouds 16 and the forestay 18.

The turnbuckle 4 has a screw 8 with a left-hand thread and a screw with a right-hand thread 10. The screws are threaded into the turnbuckle frame 28 from opposite sides of the frame. Tension is adjusted by rotating the frame with flywheel 6, which causes both screws to be screwed in or out of the frame simultaneously, without twisting the backstay 2.

The flywheel 6 is of sufficiently large diameter and weighting near the perimeter of the flywheel such that rapid manual rotation of the flywheel when there is little tension on the backstay 2 will cause the flywheel to continue to spin for a limited time and add tension to the backstay after the flywheel is released. That is, manually grasping the flywheel and rotating it by a quick movement, such as a flick of the wrist, will cause the flywheel to continue to rotate, or freewheel, after releasing the flywheel. The flywheel gradually slows and eventually stops as tension in the backstay increases. The flywheel stores rotational energy that is input by the quick and forceful manual movement, allowing the flywheel to temporarily continue to rotate after release of the flywheel. The freewheeling flywheel allows a helmsman to quickly begin tensioning a backstay while leaving the flywheel actuated backstay tensioner to attend to other matters. This feature is particularly beneficial for single handed sailing. Fine tuning backstay tension can be attended to later when time permits. The larger diameter and weighting of the flywheel also provides a mechanical advantage when applying greater torque to the backstay during fine tuning of the backstay.

The flywheel 6 of the invention is preferred to have a diameter that is not less than 20 centimeters. The larger diameter uses the mechanical advantage of less force over a larger distance gained by the diameter of the flywheel. The flywheel should be relatively heavy, especially near the outer circumference, so that once in motion the flywheel continues spinning due to momentum from reserved rotational energy. It is preferred that 60% of the weight of the flywheel is more than 8.0 centimeters from the center of the flywheel.

In one embodiment, the flywheel is formed as having a plurality of spokes 24 formed of lightweight material, such as magnesium alloy, aluminum, plastic (such as high density polyethylene) or carbon fiber. The plurality of spokes reduce weight towards the center of the flywheel, as opposed to employing a solid wheel. These materials are also corrosion resistant, which is especially important in saltwater environments. The perimeter or outer band 26 of one embodiment of the flywheel may be weighted with a heavier material such as lead or a lead alloy, or stainless steel. A rubber or plastic coating or other resilient coating may wholly or partially cover the weighting material to protect the weighting material of the outer band and to providing a gripping surface for rapidly rotating the flywheel. The plurality of spokes connects the outer band to the frame 28 of the turnbuckle. The frame may engage a center hub 30 of the flywheel that is connected to a plurality of spokes.

The flywheel actuated backstay tensioner is a connector that connects the backstay 2 to the hull 14 and the mast 20 of the sailboat. As will all connectors, particularly those under tension, and those that can be dynamically actuated, there is a possibility of the connector breaking. In this case, failure of the flywheel actuated backstay tensioner can lead to the mast falling, which is dangerous and expensive to repair. A safety strap 32 is preferably employed to connect a portion of the backstay, such as an end of the backstay 2, to a location that is below the turnbuckle, such as the hull. The ends of the safety strap 32 may attach rigidly to the shackles of the turnbuckle screws 8, 10 so that upon rotation of the flywheel 6 the turnbuckle 4 does not rotate and twist the backstay 2. The safety strap as shown has an arcuate shape that bends away from the flywheel actuated backstay tensioner so as to not interfere with rotation of the flywheel. The arcuate shape of the safety strap may be a C shape as shown in the drawings. The safety strap is formed to be substantially rigid and hold its shape under tension applied by a backstay in the event of failure of the flywheel actuated backstay tensioner, although the safety strap may have some flexibility so that it is not brittle. The safety strap may be formed of corrosion resistant metal or of carbon fiber.

The flywheel actuated backstay tensioner is inexpensive to manufacture as compared to other dynamic backstay adjustment devices in use. Once installed it is largely maintenance free, perhaps needing occasional cleaning or lubrication.

What is claimed:

1. A flywheel actuated backstay tensioner for tensioning a backstay cable of a sailboat, comprising:

a turnbuckle connected to a backstay cable of the sailboat;

a flywheel rotationally connected to a frame of the turnbuckle, wherein rotation of the flywheel rotates the frame of the turnbuckle to actuate screws that engage the frame of the turnbuckle, wherein the screws move toward each other upon rotation of the flywheel and frame of the turnbuckle and communicate with the backstay cable to tension the backstay cable.

2. A flywheel actuated backstay tensioner for tensioning a backstay cable of a sailboat as described in claim 1, wherein the flywheel has a diameter of not less than 20 centimeters.

3. A flywheel actuated backstay tensioner for tensioning a backstay cable of a sailboat as described in claim 1, wherein not less than 60% of total flywheel weight is more than 8.0 centimeters from a center of the flywheel.

4. A flywheel actuated backstay tensioner for tensioning a backstay cable of a sailboat as described in claim 1, wherein the flywheel has a diameter of not less than 20 centimeters and not less than 60% of total flywheel weight is more than 8.0 centimeters from a center of the flywheel.

5. A flywheel actuated backstay tensioner for tensioning a backstay cable of a sailboat as described in claim 1, wherein flywheel weight near an outer circumference of the flywheel applies sufficient angular momentum to the flywheel to cause the flywheel to temporarily freewheel while the sailboat is under sail with tension on the backstay cable when sufficient force is applied to the flywheel to rotate the flywheel.

6. A flywheel actuated backstay tensioner for tensioning a backstay cable of a sailboat as described in claim 1, further comprising a center hub that engages the frame of the turnbuckle, wherein the flywheel comprises a plurality of spokes that engage the center hub, wherein the flywheel comprises a weighted outer band, and wherein the plurality of spokes engage the weighted outer band and connect the weighted outer band to the center hub.

7. A flywheel actuated backstay tensioner for tensioning a backstay cable of a sailboat as described in claim 1, further comprising an arcuate alignment band that connects a portion of the backstay cable that is above the turnbuckle to a location that is below the turnbuckle.

8. A flywheel actuated backstay tensioner for tensioning a backstay cable of a sailboat as described in claim 1, further comprising an arcuate safety strap that is connected to the backstay cable and is constructed and arranged to connect the backstay cable to a hull of the sailboat upon failure of the turnbuckle.

9. A flywheel actuated backstay tensioner for tensioning a backstay cable of a sailboat as described in claim 1, further comprising a center hub that engages the frame of the turnbuckle, wherein the flywheel comprises a plurality of spokes that engage the center hub, wherein the flywheel comprises a weighted outer band, and wherein the plurality of spokes engage the weighted outer band and connect the weighted outer band to the center hub, and wherein not less than 60% of total flywheel weight is more than 8.0 centimeters from a center of the flywheel.

10. A flywheel actuated backstay tensioner for tensioning a backstay cable of a sailboat as described in claim 1, wherein a first screw of the screws is attached to an end of the backstay cable.

11. A flywheel actuated backstay tensioner for tensioning a backstay cable of a sailboat as described in claim 1, wherein a first screw of the screws is attached to an end of the backstay cable and a second screw of the screws is attached to a hull of the sailboat.

* * * * *